US010149503B2

(12) United States Patent
Bersamin

(10) Patent No.: US 10,149,503 B2
(45) Date of Patent: Dec. 11, 2018

(54) ALL-IN-ONE WATER APPAREL

(71) Applicant: Joanne Chan Bersamin, San Francisco, CA (US)

(72) Inventor: Joanne Chan Bersamin, San Francisco, CA (US)

(73) Assignee: Joanne Chan Bersamin, San Francisco, CA (US)

( * ) Notice: Subject to any disclaimer, the term of this patent is extended or adjusted under 35 U.S.C. 154(b) by 249 days.

(21) Appl. No.: 14/966,605

(22) Filed: Dec. 11, 2015

(65) Prior Publication Data

US 2017/0164668 A1 Jun. 15, 2017

(51) Int. Cl.

| | |
|---|---|
| ***A41D 15/04*** | (2006.01) |
| ***A41C 3/08*** | (2006.01) |
| ***A41C 3/00*** | (2006.01) |
| ***A41C 3/06*** | (2006.01) |
| ***A42B 1/04*** | (2006.01) |
| ***A41D 27/20*** | (2006.01) |
| ***A41D 7/00*** | (2006.01) |

(52) U.S. Cl.

CPC ..... *A41D 15/04* (2013.01); *A41C 3/0007* (2013.01); *A41C 3/06* (2013.01); *A41C 3/08* (2013.01); *A41D 7/00* (2013.01); *A41D 27/201* (2013.01); *A42B 1/048* (2013.01)

(58) Field of Classification Search

CPC ..... A41B 11/003; A41B 9/00; A41B 9/02; A41D 13/012; A41D 7/00; A41D 7/005; A41D 1/002; A41C 3/0042; A45F 4/00

USPC ..... 2/67, 69, 406, 400, 403, 227, 228, 238, 2/239, 409, 84; 150/103

See application file for complete search history.

(56) References Cited

U.S. PATENT DOCUMENTS 3,704,469 A * 12/1972 Levy ..... A41D 7/00 2/67
3,771,172 A * 11/1973 Barg ..... A41D 7/00 2/67
3,774,241 A * 11/1973 Zerkle ..... A41B 9/002 2/403
4,028,740 A * 6/1977 Luerken ..... A41D 7/005 2/67
4,145,762 A * 3/1979 Wallach ..... A41D 27/20 2/238
4,227,266 A * 10/1980 Russell ..... E04H 4/12 137/362
5,097,537 A * 3/1992 Ewing ..... A41B 11/003 2/239
5,159,716 A * 11/1992 Takata ..... A41D 13/012 2/2.16

(Continued)

*Primary Examiner* — Gloria Hale

(57) ABSTRACT

An article of water resistant clothing that includes a water resistant underlay layer. The water resistant underlay layer includes at least one compression panel to compress a portion of a body of a user wearing the water resistant clothing. The article of swimwear includes a water resistant overlay layer disposed over the water resistant underlay layer. The water resistant overlay layer exposes at least a portion of the water resistant underlay layer through material of the water resistant overlay layer. The article of water resistant clothing includes a set of fasteners embedded in at least one of the water resistant underlay layer or the water resistant overlay layer to couple the water resistant underlay layer to the water resistant overlay layer.

34 Claims, 18 Drawing Sheets

(56) References Cited

U.S. PATENT DOCUMENTS

| | | | | | |
|---|---|---|---|---|---|
| 5,182,812 | A * | 2/1993 | Goldsby | A61H 36/00 | 2/227 |
| 5,383,236 | A * | 1/1995 | Sesselmann | A41D 13/00 | 2/1 |
| 6,174,217 | B1 * | 1/2001 | Judson | A41C 3/0042 | 2/406 |
| 6,240,560 | B1 * | 6/2001 | DeCaro | A41B 9/002 | 2/67 |
| 8,212,229 | B2 * | 7/2012 | Slinkard | A01M 31/025 | 2/69 |
| 8,405,058 | B2 * | 3/2013 | Slinkard | A01M 31/00 | 2/69 |
| 2004/0098784 | A1 * | 5/2004 | Desai | A41B 9/00 | 2/69 |
| 2005/0060792 | A1 * | 3/2005 | Desai | A41B 9/00 | 2/403 |
| 2009/0241236 | A1 * | 10/2009 | Rotheram | A41D 1/002 | 2/84 |
| 2013/0056118 | A1 * | 3/2013 | Lee | A45F 4/00 | 150/103 |
| 2014/0007318 | A1 * | 1/2014 | Jones | A41D 1/08 | 2/227 |
| 2014/0196188 | A1 * | 7/2014 | Brady | A41D 7/00 | 2/67 |
| 2015/0007374 | A1 * | 1/2015 | Larson | A41D 7/00 | 2/67 |
| 2016/0374421 | A1 * | 12/2016 | Washington | A42B 1/245 | 2/84 |

* cited by examiner

ALL-IN-ONE WATER APPAREL

TECHNICAL FIELD

Aspects and implementations of the present disclosure relate to water apparel, and more specifically, to an all-in-one water apparel.

BACKGROUND

Data in the global swimwear and beachwear market shows there is a growing interest in body care and mobility. Typical wetsuit and modesty swimwear is generally heavy and restrictive and can limit a person's movement. In addition, some people may desire extra body coverage while being exposed to the sun and/or water due to lifestyle, fitness, health, modesty, and/or for medical reasons. Generally, traditional swimwear cannot be expanded to provide extra body coverage.

BRIEF DESCRIPTION OF THE DRAWINGS

Aspects and implementations of the present disclosure will be understood more fully from the detailed description given below and from the accompanying drawings of various aspects and implementations of the disclosure, which, however, should not be taken to limit the disclosure to the specific aspects or implementations, but are for explanation and understanding only.

DETAILED DESCRIPTION

Aspects and implementations of the present disclosure are directed to all-in-one water apparel. Implementations of the present disclosure provide water apparel that can be customized to an individual user's needs and/or preferences. For example, components of the all-in-one water apparel can be attached and/or detached to increase UV (ultraviolet) protection, add warmth as temperatures change, and/or extra body coverage for a multitude of skin conditions (e.g. scarring, cellulite, dermatitis, discoloration, stretch marks, spider and varicose veins). Typical wetsuits and modesty swimwear are generally heavy and restrictive and can limit a user's movement. The customization of the components of the all-in-one water apparel for a particular user can allow the particular user to seamlessly move between any sport, recreation, leisure, entertainment, amusement event, or water activity quickly and comfortably. The components of the all-in-one water apparel present a user with a myriad of water resistant clothing wardrobe options. The components of the all-in-one water apparel provide strongly constructed body shapers as uniquely camouflaged compression panels, and a cohesive design when multiple components of the all-in-one water apparel are worn collectively.

Figure 1:
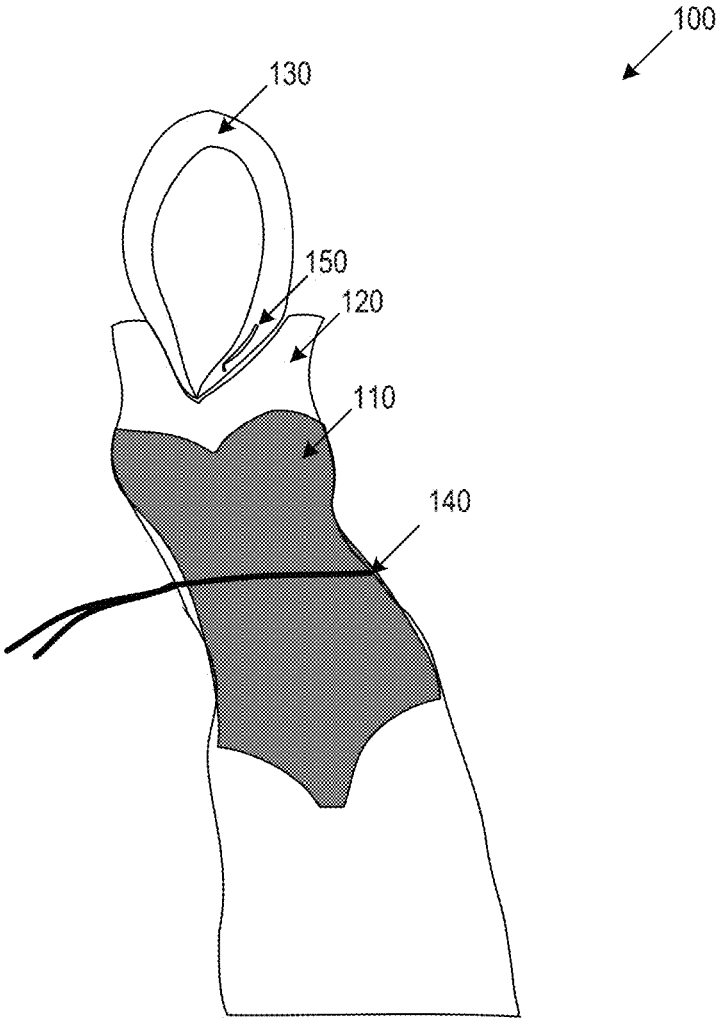
FIG. 1 is a front view of an example ensemble of all-in-one water apparel, in accordance with one example of the present disclosure.

FIG. 1 is a front view of an example ensemble of all-in-one water apparel 100, in accordance with one example of the present disclosure. The all-in-one water apparel 100 can be a multi-functional water resistant clothing ensemble that includes one or more components, such as, an underlay layer 110, an overlay layer 120, a head piece 130, a sash 140 or a combination thereof. For example, the all-in-one water apparel 100 may include an underlay layer 110 and an overlay layer 120. The all-in-one water apparel 100 can include multiple components that are the same component. For example, the all-in-one water apparel 100 may include multiple sashes 140 and/or multiple head pieces 130. As described in greater detail below in conjunction with FIGS. 12-17, a head piece 130 can be transformed in to a garment (e.g., hoodie, top, dress, skirt, scarf, container tote bag, blouse, wrap/shawl), in accordance with various examples of the present disclosure. In another example, the all-in-one water apparel 100 may include an underlay layer 110 and a head piece 130. In another example, the all-in-one water apparel 100 may include an underlay layer 110, an overlay layer 120 and a head piece 130. In another example, the all-in-one water apparel 100 may include a single head piece 130. In one example, the all-in-one water apparel 100 may include a sash 140 or belt with one or more other components (e.g., underlay layer 110, overlay layer 120, and head piece 130).

The head piece 130 can include one or more pockets 150 to hold small objects (e.g., phone, keys, identification card, credit card, money). In one example, one or more components (e.g., sash, underlay layer, overlay layer, and head piece) of an all-in-one water apparel can contain one or more pockets that can hold small objects (e.g., phone, keys, identification card, credit card, money). The pockets can be hidden, for example, by fabric of the all-in-one water apparel. The pockets can be located, for example, in a bottom component, waistband, sleeve, and/or sash. The pockets can be closed, for example, using zippers, snaps, buttons, Velcro, and/or ties.

The underlay layer 110 can be a foundational water resistant garment. The overlay layer 120 can be an attachable or detachable cover-up water resistant garment. The head piece 130 can be an attachable or detachable head water resistant garment. In one example, the overlay layer 120 may cover a greater portion of the body of the user than the underlay layer 110. The sash 140 can be an attachable or detachable water resistant garment. A user can wear an underlay layer 110 and wear the overlay layer 120 on top of the underlay layer 110. In one example, the overlay layer 120 may be worn over the underlay layer 110 and be detached from the underlay layer 110. In another example, the overlay layer 120 can be attached to the underlay layer 110. In one example, a user can wear the head piece 130 and attach the head piece 130 to underlay layer 110 and/or overlay layer 120. In one example, the head piece 130 converts into a reversible hoodie, top, dress, skirt, and/or scarf that can be worn with or without the underlay layer 110 and/or the overlay layer 120. In one example, the head piece 130 transforms into a container, which a user may use to hold or carry the underlay layer 110 and/or overlay layer 120 in the container.

The underlay layer 110, overlay layer 120, head piece 130 and sash 140 can be constructed of water resistant material and can include varying densities of spandex or other water resistant materials or a combination thereof. The underlay layer 110, overlay layer 120, head piece 130, and sash 140 can include solid colors, designs, and/or patterns. For example, the underlay layer 110, overlay layer 120, head piece 130 and/or sash 140 may comprise traditional art designs, urban art designs, graffiti art designs and/or contemporary art designs. Multiple components can be of the same material, design, and/or pattern as one or more other components. For example, the sash 140 can be of the same material, design, and/or pattern as the underlay layer 110, overlay layer 120, and/or head piece 130.

The underlay layer 110, overlay layer 120, head piece 130, and sash 140 can have various types of attached trims, and/or encompass different types of textures that are printed or embossed onto the underlay layer 110, overlay layer 120, head piece 130, and sash 140, or combinations thereof.

The components (e.g., underlay layer 110, overlay layer 120, head piece 130, and sash 140) of the all-in-one water apparel 100 can be for any age and gender. The components can have various dimensions to fit babies, toddlers, children, youth, and adult sizes. The material of the components has one or more colors, traditional designs, compelling designs, hems, and/or trimmings.

Figure 2:
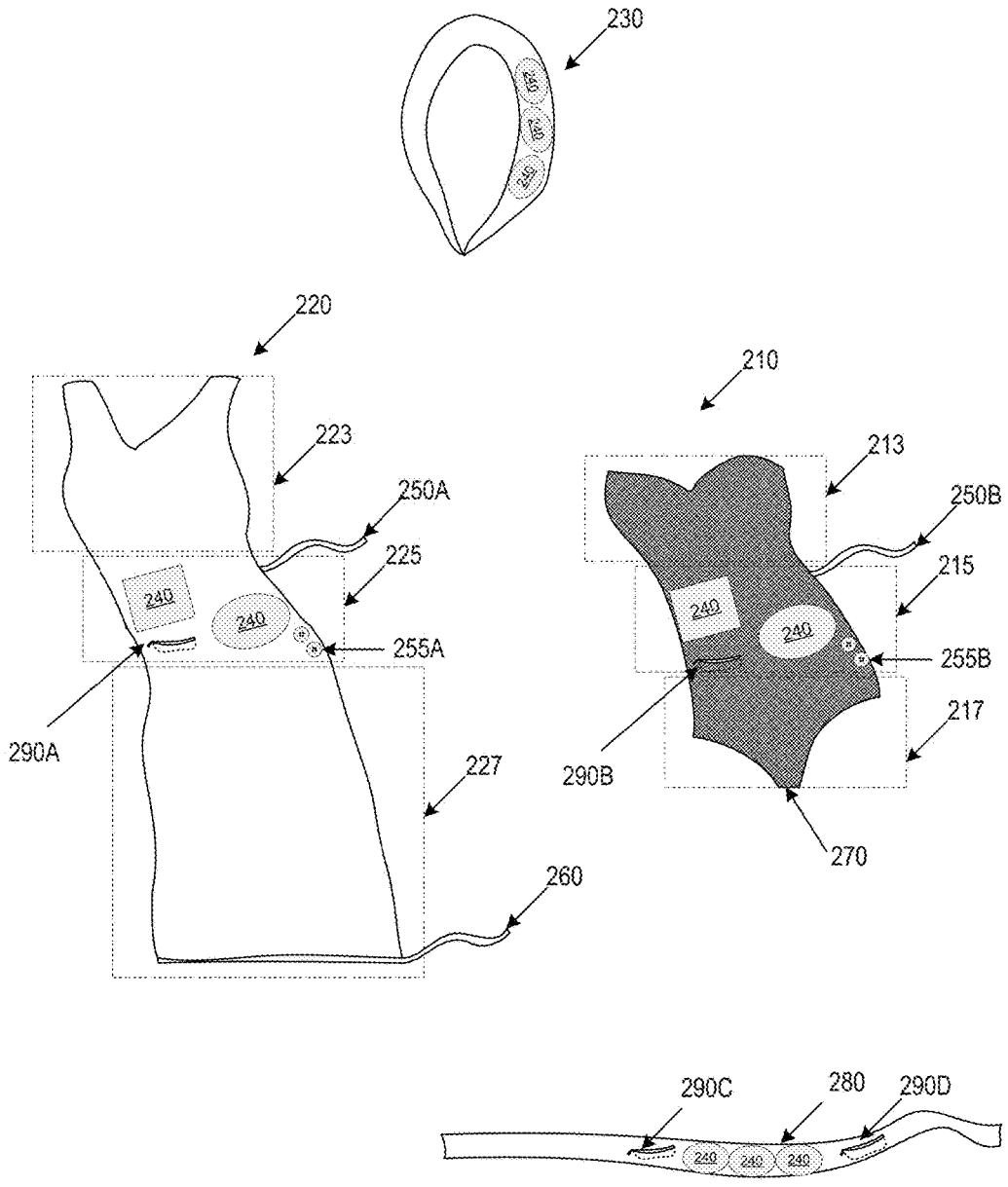
FIG. 2 is a front view of example individual components of all-in-one water apparel, in accordance with one example of the present disclosure.

FIG. 2 is a front view of example individual components of all-in-one water apparel, in accordance with one example of the present disclosure. The individual components can include an underlay layer 210, an overlay layer 220, a head piece 230, a sash 280 or a combination thereof. The underlay layer 210 can include a top section 213, middle section 215, and bottom section 217. The overlay layer 220 can include a top section 223, middle section 225, and bottom section 227.

The overlay layer 220 can be disposed over the underlay layer 210 and can be constructed of a material (e.g., transparent material) that exposes at least a portion of the underlay layer 210 through the material of the overlay layer 220. An underlay layer 210 could have one or more stylized accompanying overlay layers 220 that match the underlay layer 210 in color, patterns, and/or design.

A component (e.g., overlay layer 220, underlay layer 210, head piece 230, sash 280) can have one or more areas of light support or translucency (e.g., mesh and/or transparent Spandex) to render a more airy and softer garment. A component can consist of fabrics that have strong elasticity, are water resistant, waterproof, windproof, and breathable, or a combination thereof. Example fabrics can include, and are not limited to, mesh and a polyester-polyurethane copolymer synthetic fiber, principally known as Spandex, Elastane, or Lycra. Other example fabrics can include, and are not limited to, wicking fabrics, micro-fleece, stretchable jersey, and/or nylon. In the fabric making process, the synthetic fiber can be treated to stick together and can include a percentage of cotton, nylon, or other material. The synthetic fiber can be fast drying, can expand up to five times its length and has the ability to return to its original shape despite being stretched or saturated with water. Layering the synthetic fibers can concisely and more densely create a compression panel 240 (also known as a "body shaper"). Layering the synthetic fibers more loosely can establish a light support or translucent area of the component (e.g., overlay layer 220, underlay layer 210, head piece 230, sash 280).

A component (e.g., overlay layer 220, underlay layer 210, head piece 230, sash 280) can have one or more pockets. The pockets can be hidden, for example, by fabric of the all-in-one water apparel. For example, overlay layer 220 may include pocket 290A. In another example, underlay layer 210 may include pocket 290B. In another example, sash 280 may include pocket 290C and pocket 290D.

In one example, the overlay layer 220 can be attached to the underlay layer 210 via a set of fasteners. The set of fasteners can include one or more mechanisms, such as, and not limited to zippers, cloth strips, ribbon, string, magnetic snaps, buttons, and/or drawstrings and cord locks. The set of fasteners can be water resistant. The fasteners can be durable, have minimum risk of snagging the fabric, and contain impermeable properties to aide in anti-corrosion and low degree of deterioration due to frequent water immersion and susceptibility to getting wet. For example, the overlay layer 220 can include a fastener (e.g., ribbon 250A) to tie to a fastener (e.g., ribbon 250B of the underlay layer 210. In another example, the overlay layer 220 and/or underlay layer 210 include one or more buttons 255A-255B as fasteners. In one example, even when the overlay layer 220 includes a set of fasteners, the overlay layer 220 can be detached from the underlay layer 210 and still be disposed over the underlay layer 210. In one example, the overlay layer 220 can include a set of fasteners and a portion of the set of fastens are used to attach the overlay layer 220 to the underlay layer 210.

A layer (e.g., overlay layer 220, underlay layer 210) can be one or more pieces. For example, a layer (e.g., overlay layer 220, underlay layer 210) may be a one-piece water resistant piece of clothing. An all-in-one water apparel having a multi-piece underlay layer is described in greater detail below in conjunction with FIG. 6, in accordance with one example of the present disclosure.

Referring to FIG. 2, a bottom component (e.g., bottom section 217, bottom section 227) can be a bikini bottom, skirt, shorts, skort (combination of skirt/shorts), legging and pants. A component (e.g., overlay layer 220, underlay layer 210, head piece 230, sash 280) can include one or more compression panels 240 to provide specific areas of firm support. In one example, the compression panels 240 are embedded in a component and not visible to a user. In another example, the compression panels 240 are embedded in a component and visible to a user. The compression panels 240 can compress or exert pressure to portions of a body of a user. The built-in compression panels 240 can be made of body slimming technology for slenderizing specific areas (e.g., the abdomen/mid-section areas) of a user's body. Fiber layering manufacturing practices, embroidery and/or other ornamental design techniques can be used to mask the compression panels 240 and add fashionable design aspects throughout the all-in-one water apparel. In one example, each compression panel is made of a combination of synthetic fibers that is different from a respective component (e.g., underlay layer 210, overlay layer 220, head piece 230, sash 280).

The compression panels 240 can be embedded in one or more sections of a component. For example, the compression panels may be embedded in a top section (e.g., top section 213, top section 223), middle section (e.g., middle section 215, middle section 225), and/or bottom section (e.g., bottom section 217, bottom section 227) of a layer (e.g., underlay layer 210, overlay layer 220), one or more portions of a head piece 230, and or one or more portions of a sash 280. Compression panels 240 can be located on one or more areas of a component to support a user's abdomen, ankles, arms, back, belly, buttocks, calves, chest, hips, knees, ribs, sides, thighs, and/or waist. As described in greater detail below in conjunction with FIGS. 12-17, the head piece 230 can be transformed into a garment (e.g., hoodie, top, dress, skirt, scarf, container tote bag, blouse, wrap/shawl), and may include one or more compression panels 240 to support a user's abdomen, ankles, arms, back, belly, buttocks, calves, chest, hips, knees, ribs, sides, thighs, and/or waist when transformed into a garment, in accordance with various examples of the present disclosure. Other body slimming techniques can applied to the all-in-one water apparel, such as a ruching sewing technique, color blocking, fringing, corset binding, peplum designs, and/or combining dense or light layers of synthetic fibers to create patterns (e.g. greek key, scallops, lace, or stripes) for the compression panels 240. Additional accouterments, such as, and not limited to, zippers, embroidered stitching, bedazzling, ornamental add-ons, ribbons, tassels, and piping, can applied to the all-in-one water apparel.

The compression panels 240 can be of the same shape or of different shape. A component can include a series of compression panels 240. A component (e.g., overlay layer 220, underlay layer 210, head piece 230, sash 280) can include a variety of sections, such as, section(s) of firm support provided by compression panels, area(s) of light support, and area(s) of translucency made from mesh and/or transparent Spandex.

Figure 3:
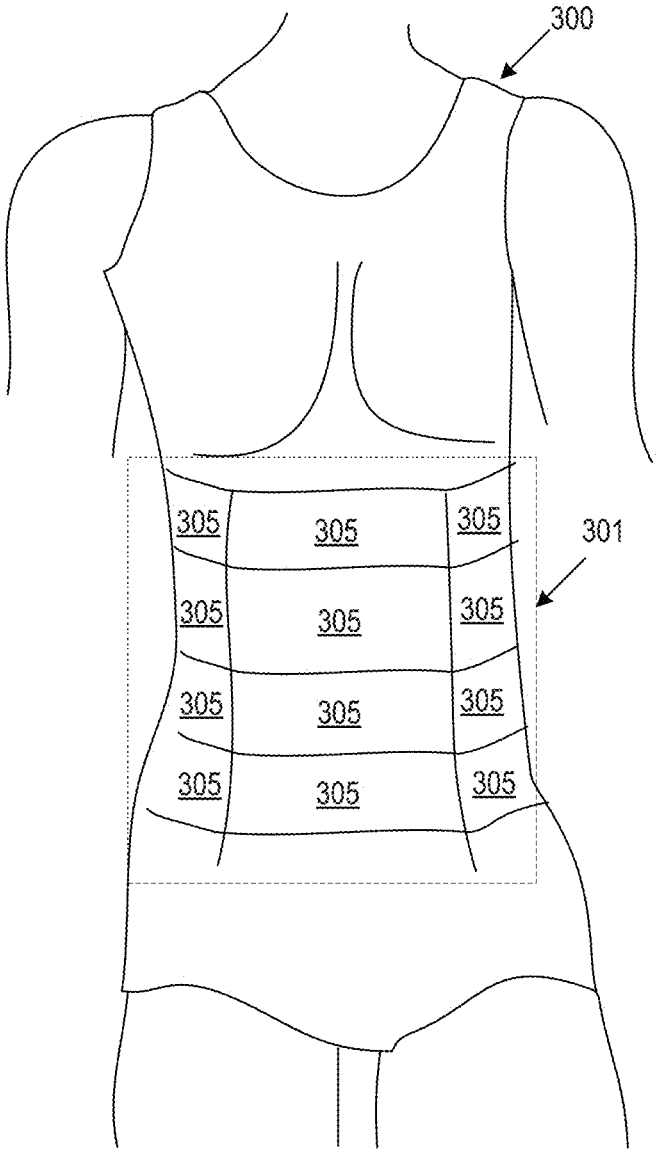
FIG. 3 illustrates an example layer having a series of compression panels, in accordance with one example of the present disclosure.

FIG. 3 illustrates an example layer 300 having a series of compression panels, in accordance with one example of the present disclosure. The layer 300 can be an underlay layer or an overlay layer. The layer 300 can include series 301 of compression panels 305 that are strategically placed in areas of the layer 300 to compress or exert pressure to one or more body portions of a user. For example, the series 301 of compression panels 305 can be placed to compress a user's belly, abdomen, back, chest, and/or oblique areas. A compression panel 305 can be of a particular design. For example, a component (e.g., head piece, overlay layer, underlay layer, sash) of the all-in-one water apparel can include compression panels that are a series of a Greek key design.

Figure 4:
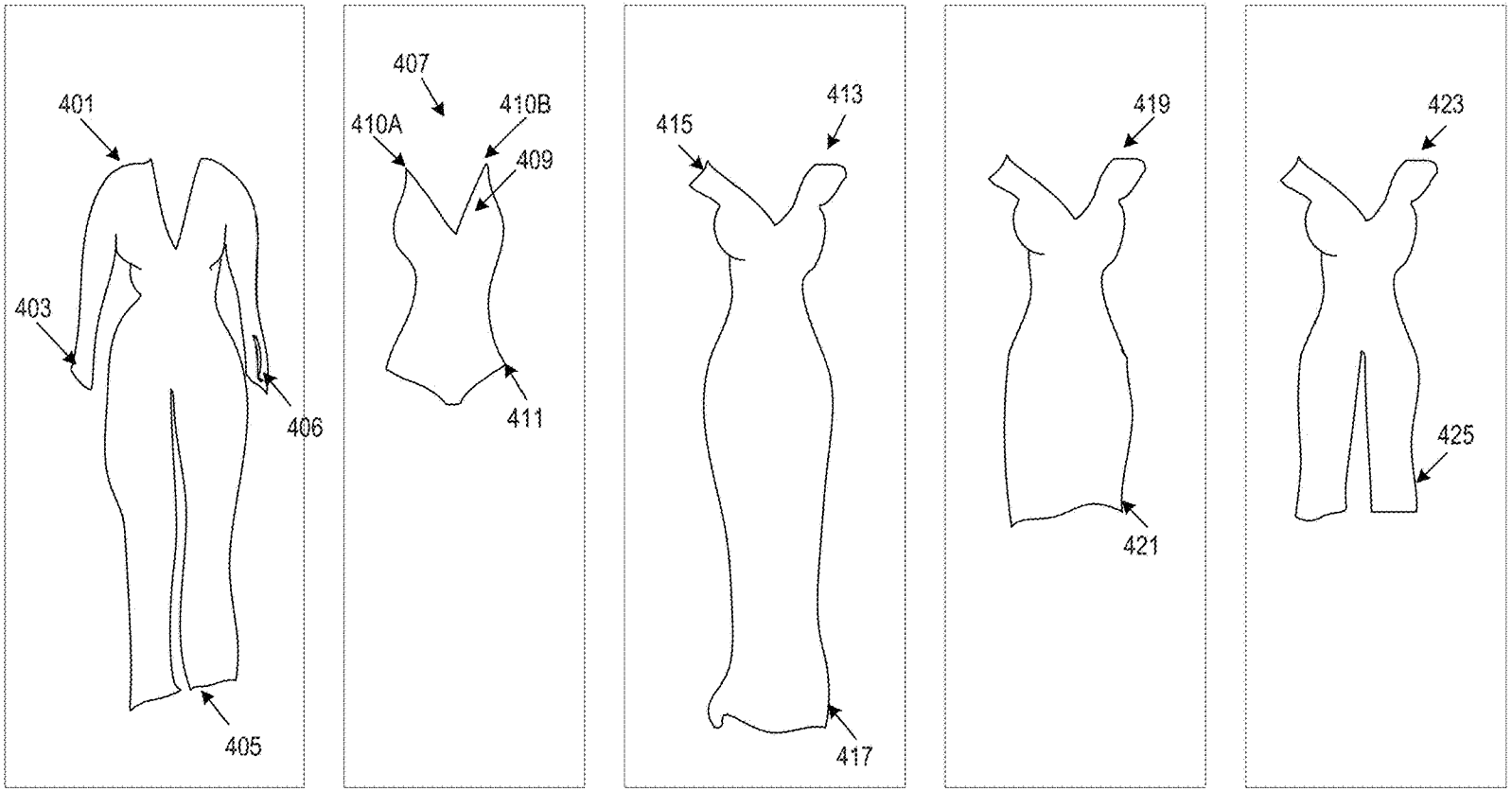
FIG. 4 illustrates various lengths and types of a layer of all-in-one water apparel, in accordance with various examples of the present disclosure.

FIG. 4 illustrates various lengths and types of a layer of all-in-one water apparel, in accordance with various examples of the present disclosure. A layer (e.g., overlay layer, underlay layer) can include, for example, and not limited to, a sarong, cover-up, dress, mid-thigh length skirt (also referred to as a "mini skirt"), and an ankle length dress/skirt (also referred to as a "maxi skirt").

A layer can include or more types of designs, such as, and not limited to, a high-cut upper back design, a low-cut halter back design, a racer back design, a crisscross strap design, and other designs that span across the front, sides, and/or back of a person's body.

A layer 401 can be one-piece jumpsuit style. The one-piece jumpsuit style can include a long sleeve top component 403 and an ankle length bottom component 405. One or more long sleeve top components 403 may include one or more pockets 406.

A layer 407 can be a one-piece swimsuit style. The one-piece swimsuit style can include a top component 409 that is sleeveless and includes two straps 410A,410B, and a hip length bottom component 411.

A layer 413 can be one-piece dress style. The one-piece dress can include a top component 415 that has sleeves that are cap length, and a full-length bottom component 417 as a maxi length dress. A layer 419 can be a one-piece dress style that has a knee-length bottom component 421 as a knee length dress. A layer 423 can be a one-piece jumpsuit style that includes a mid-thigh length bottom component 425.

Figure 5:
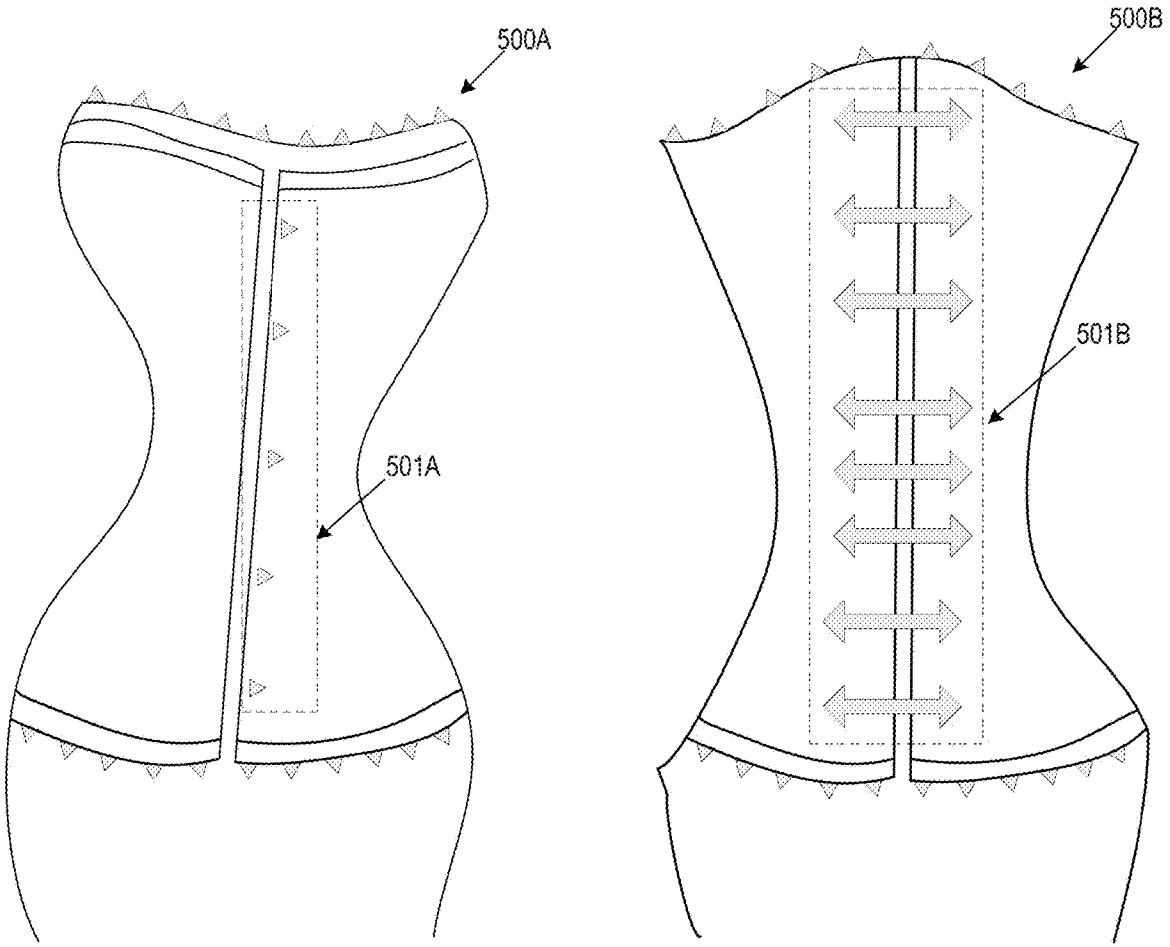
FIG. 5 illustrates a front section of a layer and a back section of a layer of all-in-one water apparel in a one-piece corset garment style, in accordance with various examples of the present disclosure.

FIG. 5 illustrates a front section 500A of a layer and a back section 500B of a layer of an all-in-one water apparel in a one-piece corset garment style, in accordance with various examples of the present disclosure. The front section 500A and/or back section 500B of a layer can include one or more fasteners 501A,501B. The fasteners 501A,501B can be one or more different fastener types. Examples of fastener types can include, and are not limited to, snaps, hooks, cords, ribbons, and/or zippers. Compression panels can be strategically placed in areas of the front section 500A and/or back section 500B of the layer to compress, for example, the sides, stomach area, thighs, back, abdomen, and/or buttocks to enhance a person's body shape.

Figure 6:
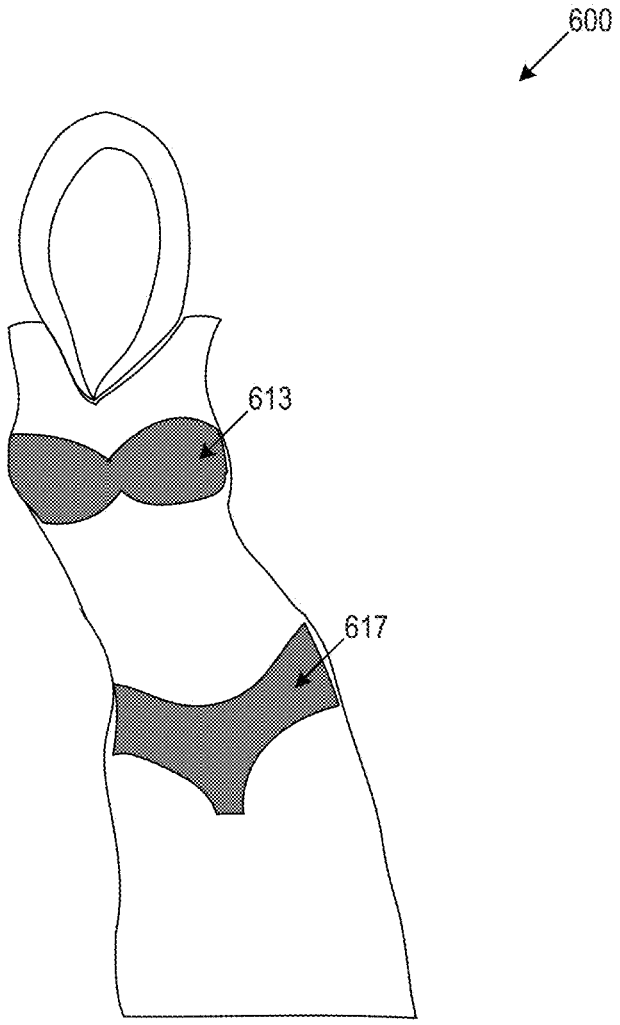
FIG. 6 is an example of all-in-one water apparel having a multi-piece layer, in accordance with one example of the present disclosure.

FIG. 6 is an example of all-in-one water apparel 600 having a multi-piece layer, in accordance with one example of the present disclosure. A layer (e.g., overlay layer, underlay layer) can be a two-piece water resistant clothing that includes distinct garments to separately cover the top and bottom portions of a user's body. The multi-piece layer can include a top piece 613 and a bottom piece 617. For a one-piece layer, "top piece" can refer a top section (e.g., top section 213 and top section 223 in FIG. 2) of the one-piece layer.

A top piece 613 can include a brassiere (hereinafter referred to as "bra") section that can have an underwire, gel inserts, or other bra mechanisms. The top piece 613 can be strapless, have one or more straps, and/or have varying sleeve lengths (e.g., cap sleeves, mid-bicep length, elbow length, mid-forearm length, wrist length).

Figure 7:
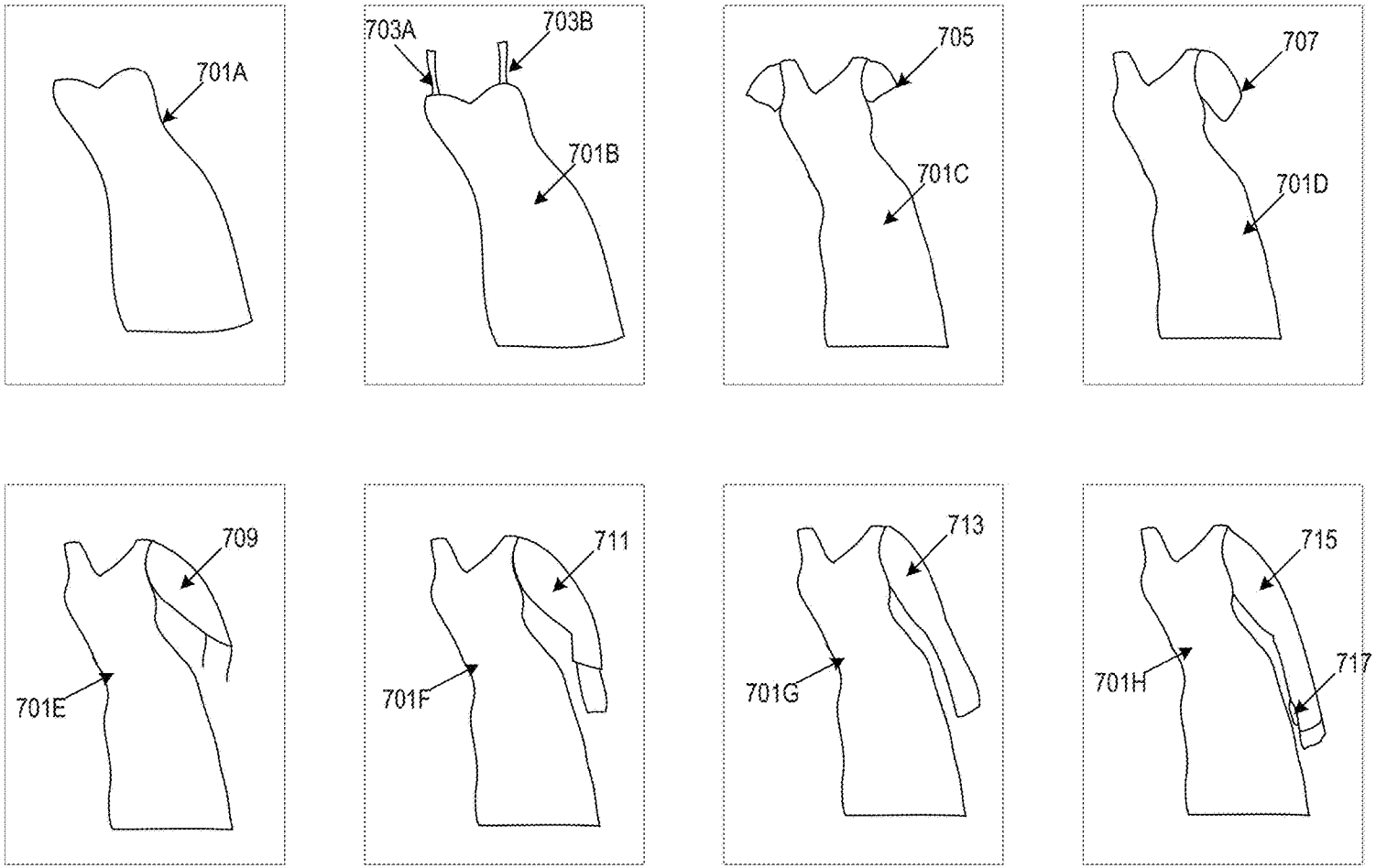
FIG. 7 illustrates various types of top sections of a layer of all-in-one water apparel, in accordance with various examples of the present disclosure.

FIG. 7 illustrates various types of top sections of a layer of all-in-one water apparel, in accordance with various examples of the present disclosure. For a multi-piece layer, "top section" can refer to a top piece (e.g., top piece 613 in FIG. 6) of the multi-piece layer. The layer can be an underlay layer or an overlay layer. Layer 701A is an example of a top section that is strapless. Layer 701B is an example of a top section having straps 703A,703B. Layer 701C is an example of a top section having cap sleeves 705. Layer 701D is an example of a top section having mid-bicep length sleeves 707. Layer 701E is an example of a top section having elbow length sleeves 709. Layer 701F is an example of a top section having mid-forearm length sleeves 711. Layer 701G is an example of a top section having full-length sleeves 713. Layer 701H is an example of a top section having full-length sleeves 715 with an opening 717 for a person's thumb to hold the sleeve in place and to slightly cover a user's hand. The full-length sleeves 713,715 can be wrist length sleeves.

Figure 8:
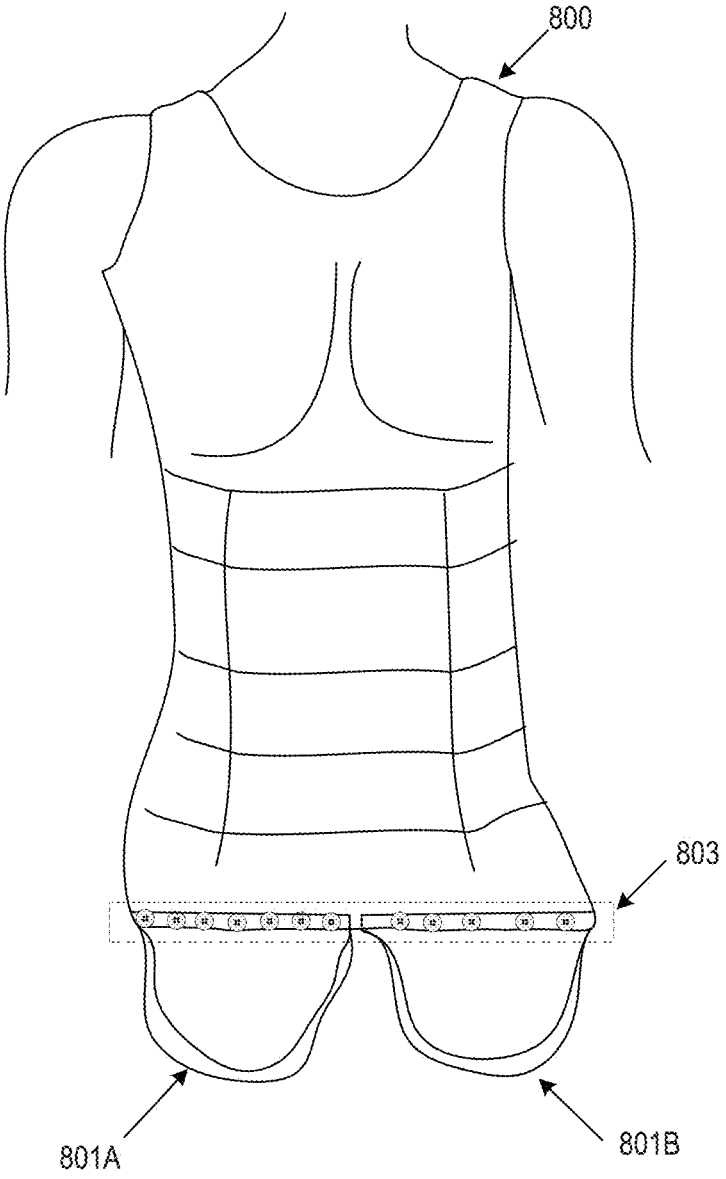
FIG. 8 illustrates a top piece including straps for securing the top piece to a person, in accordance with various examples of the present disclosure.

FIG. 8 illustrates a top piece 800 including straps 801A, 801B for securing the top piece to a person, in accordance with various examples of the present disclosure. The top piece 800 can be for example, and not limited to, a t-shirt style, tank top style, and/or vest style. The top piece 800 can have varying sleeve lengths or be sleeveless. The top piece 800 can include one or more compression panels placed in areas of the top piece 800 to compress a person's stomach area, abdomen, back, chest, and/or oblique areas.

A top piece 800 can have one or more straps 801A,801B that can encircle the upper leg(s) of a person to help hold the top piece 800 into place and to help prevent the top piece 800 from raising open or riding upwards on a person's body. For example, the pair of individual straps 801A,801B can each encircle a person's thighs respectively, where the straps 801A,801B are positioned under the backside of the person to secure the top piece 800 to the person.

In one example, the top piece 800 includes one or more types of fasteners 803 (e.g., snaps, buttons, ties, etc.) to attach the straps 801A,801B to the bottom of the top piece 800. In one example, the straps 801A,801B are sewn and affixed to the bottom of the top piece 800, and not detachable from the top piece 800.

Figure 9:
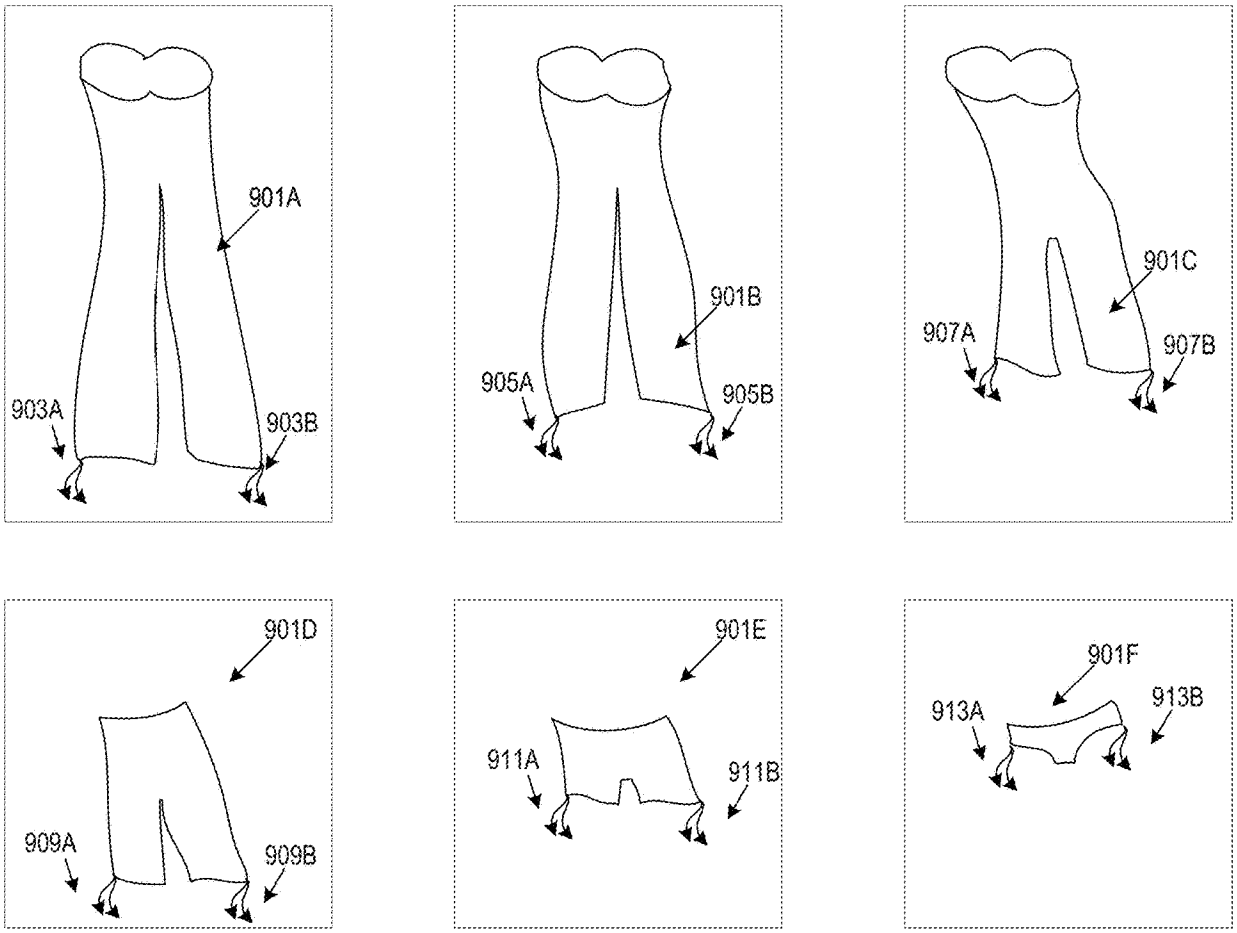
FIG. 9 illustrates various lengths of bottom pieces of a layer of all-in-one water apparel, in accordance with various examples of the present disclosure.

FIG. 9 illustrates various lengths of bottom pieces of a layer of all-in-one water apparel, in accordance with various examples of the present disclosure. For a one-piece layer, "bottom piece" can refer a bottom section (e.g., bottom section 217 and bottom section 227 in FIG. 2) of the one-piece layer. A layer can be an overlay layer or an underlay layer. A bottom piece can have diverse lengths (e.g. panty length, boy-short length, mid-thigh length, knee length, Capri length, ankle length, legging length, full pant leg). A bottom piece can include one or more mechanisms (e.g., drawstring, zipper, button and/or strap, etc.) to allow a user to adjust the length of the bottom piece. For example, bottom piece 901A includes drawstrings 903A, 903B to vary the length of the bottom piece 901A. The drawstrings 903A,903B may include cord locks. Bottom piece 901B is an example of a bottom style having a full pant leg. Bottom piece 901B is an example of a bottom style where the drawstrings 905A,905B adjust the bottom piece 901B to a Capri length. Bottom piece 901C is an example of a bottom style where the drawstrings 907A,907B adjust the bottom piece 901C to a knee length.

Bottom piece 901D is an example of a shorts bottom style having a high-waist line and a knee length. A high-waist line can be above a user's navel. Bottom piece 901D can include drawstrings 909A,909B to adjust the bottom piece 901D to the knee length. Bottom component 901E is an example of a boy short bottom style that can have a low-waist line. A low-waist line can be at or below a user's navel. The boy short bottom style can have a length that is between knee-length to upper-thigh length. For example, the boy short style can have an upper-thigh length. Bottom piece 901E can include drawstrings 911A,911B to adjust the bottom piece 901E between knee-length to upper-thigh length. Bottom piece 901F is an example of a panty bottom style having a low-waist line and an upper-leg length. In one example, the bottom piece 901F can include drawstrings 913A,913B to adjust the bottom piece 901E to upper-leg length.

Figure 10:
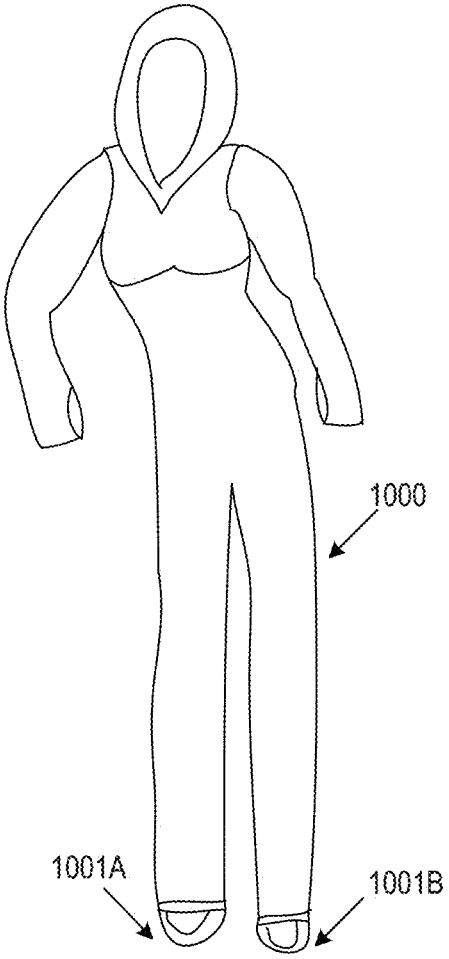
FIG. 10 illustrates straps for securing a bottom piece of a layer of all-in-one water apparel to a user, in accordance with various examples of the present disclosure.

FIG. 10 illustrates straps 1001A,1001B for securing a bottom piece 1000 of a layer of all-in-one water apparel to a user, in accordance with various examples of the present disclosure. For a one-piece layer, "bottom piece" can refer a bottom section (e.g., bottom section 217 and bottom section 227 in FIG. 2) of the one-piece layer. The layer can be an overlay layer or an underlay layer. The bottom piece 1000 can have one or more straps 1001A,1001B that encircle the arch of one or more feet of a person to hold the bottom piece 1000 in place to cover the person's ankle.

Figure 11:
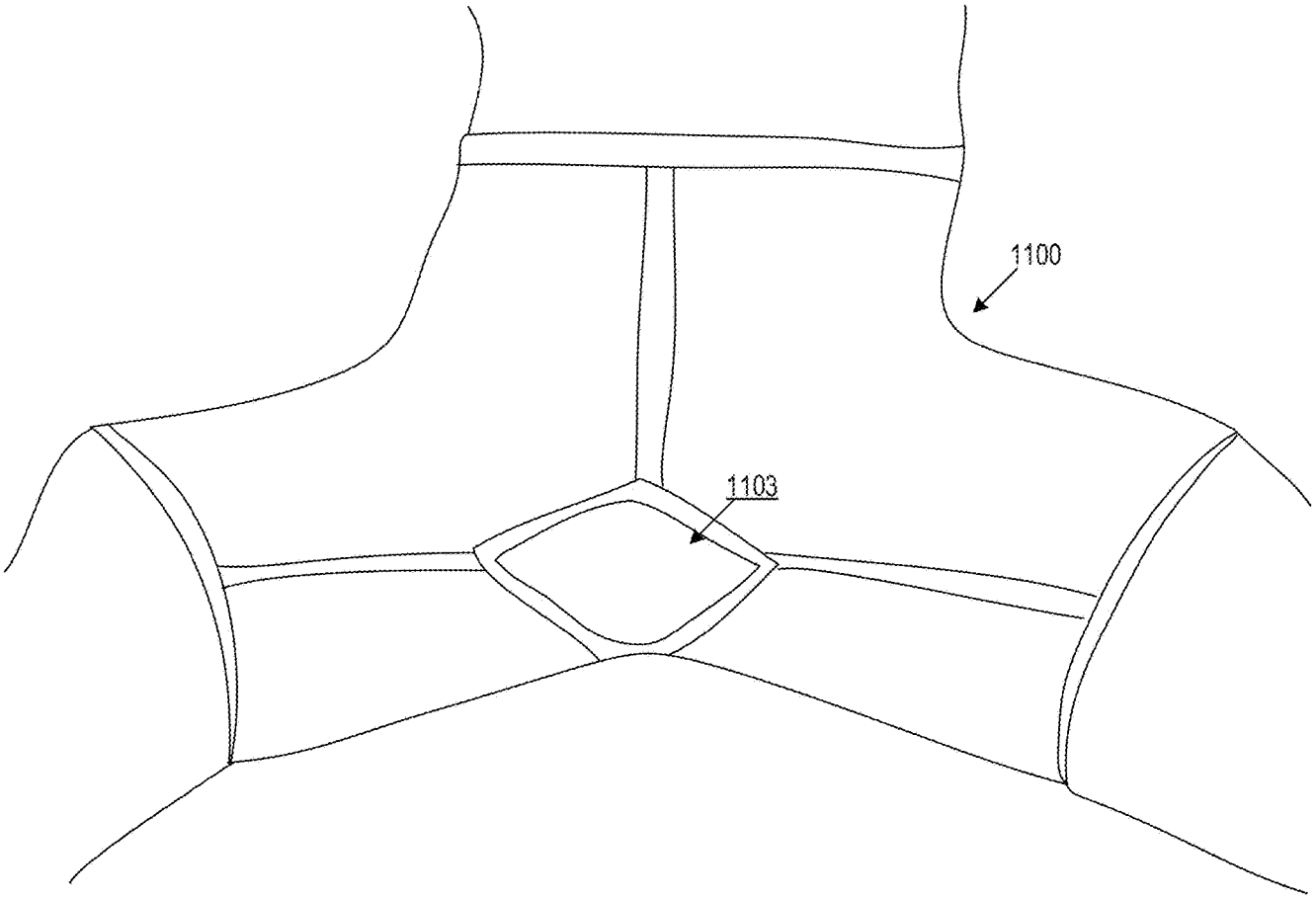
FIG. 11 illustrates a bottom piece with of a gusseted fabric piece, in accordance with various examples of the present disclosure.

FIG. 11 illustrates a bottom piece 1100 with of a gusseted fabric piece 1103, in accordance with various examples of the present disclosure. For a one-piece layer, "bottom piece" can refer a bottom section (e.g., bottom section 217 and bottom section 227 in FIG. 2) of the one-piece layer. The bottom piece 1100 can include a gusseted fabric piece 1103 that is positioned between a person's legs at a crotch area to allow the person more range of motion. The gusseted fabric piece 1103 can be positioned in a crotch area to help prevent the bottom piece 1100 from sliding up between the person's buttocks, which can limit the person's movement and/or cause uncomfortable movement. The gusseted fabric piece 1103 can be soft, flexible, and lightweight material (e.g. cotton, nylon, or spandex or combination thereof). The gusseted fabric piece 1103 can be a double-layered fabric piece and can be, for example, an oval shape, a diamond shape, a circular shape, a triangular shape, or combination thereof. For example, a double-layered diamond shaped fabric piece may be embedded in the bottom piece 1100 to be positioned between the legs of a person to provide comfortable movement of the bottom piece 1100 along the person's body.

Figure 12:
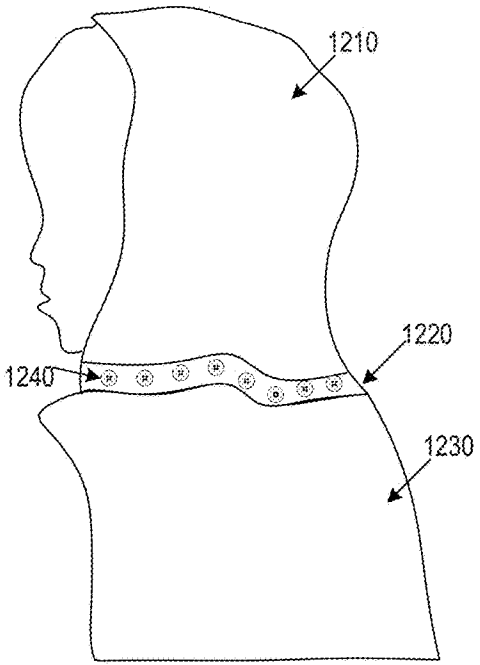
FIG. 12 illustrates an example of a head piece, in accordance with one example of the present disclosure.

FIG. 12 illustrates an example of a head piece 1210 (e.g., head piece 230 in FIG. 2), in accordance with one example of the present disclosure. The head piece 1210 can be removably attachable to the overlay layer, the underlay layer, sash and/or to another head piece to provide a person with increased sun and/or wind protection and/or extra coverage for the head, neck, face, ears, shoulders, arms, legs, and body. The head piece 1210 can be reversible and can transform into a garment (e.g., hoodie, top, dress, skirt, scarf, container tote bag, blouse, wrap/shawl). An all-in-one water apparel can include a sash (e.g., sash 140 in FIG. 1) that can be coupled to the head piece 1210 as described in greater detail below in conjunction with FIG. 15, in accordance with various examples of the present disclosure. Referring to FIG. 12, in one example, the layer 1230 can be an overlay layer, and the head piece 1210 and the overlay layer can both be outer layers of the all-in-one water apparel. In one example, the layer 1230 can be an underlay layer, and the head piece 1210 and the underlay layer can be both worn under an overlay layer of the all-in-one water apparel.

The head piece 1210 can be removably attachable to a layer (e.g., underlay layer 220 and/or an overlay layer 210 in FIG. 2) via a set of fasteners 1240. The head piece 1210 can be attached to and/or detached from a layer 1230 (e.g., overlay layer 220, underlay layer 210 in FIG. 2) by a set of fasteners 1240 in a fastener panel 1220. The set of fasteners 1240 can include, for example, magnetic snaps, buttons, and/or drawstrings and/or cord locks on either end of the fastener panel 1220. The set of fasteners 1240 can be water resistant. The set of fasteners 1240 can be durable, have minimum risk of snagging the fabric, and contain impermeable properties to aide in anti-corrosion and low degree of deterioration due to frequent water immersion and susceptibility to getting wet.

One or more sides of the head piece 1210 can be of the same color, design, and/or pattern, or may be different colors, designs, and/or patterns. The head piece 1210 can also have hem borders, trimmings and other accouterments to produce an abundant and versatile fashion wardrobe for use, for example, in or out of the water.

The head piece 1210 can be used for utilitarian purposes due to lifestyle, fitness, health, modesty, and/or medical reasons where a person can pair the head piece 1210 with the all-in-one water apparel or with other apparel to increase sun protection, body concealment, and provide additional skin coverage. The head piece 1210 can provide sun and wind protection and/or extra coverage for the head, neck, face, ears, shoulders, arms, legs, and body depending on the desires of the person.

The head piece 1210 can be folded and/or rolled up as a very compact item to be stored away. The head piece 1210 can be reversible with different colors and designs on either side of the fabric(s) of the head piece 1210 to increase its usefulness and flexibility.

Figure 13:
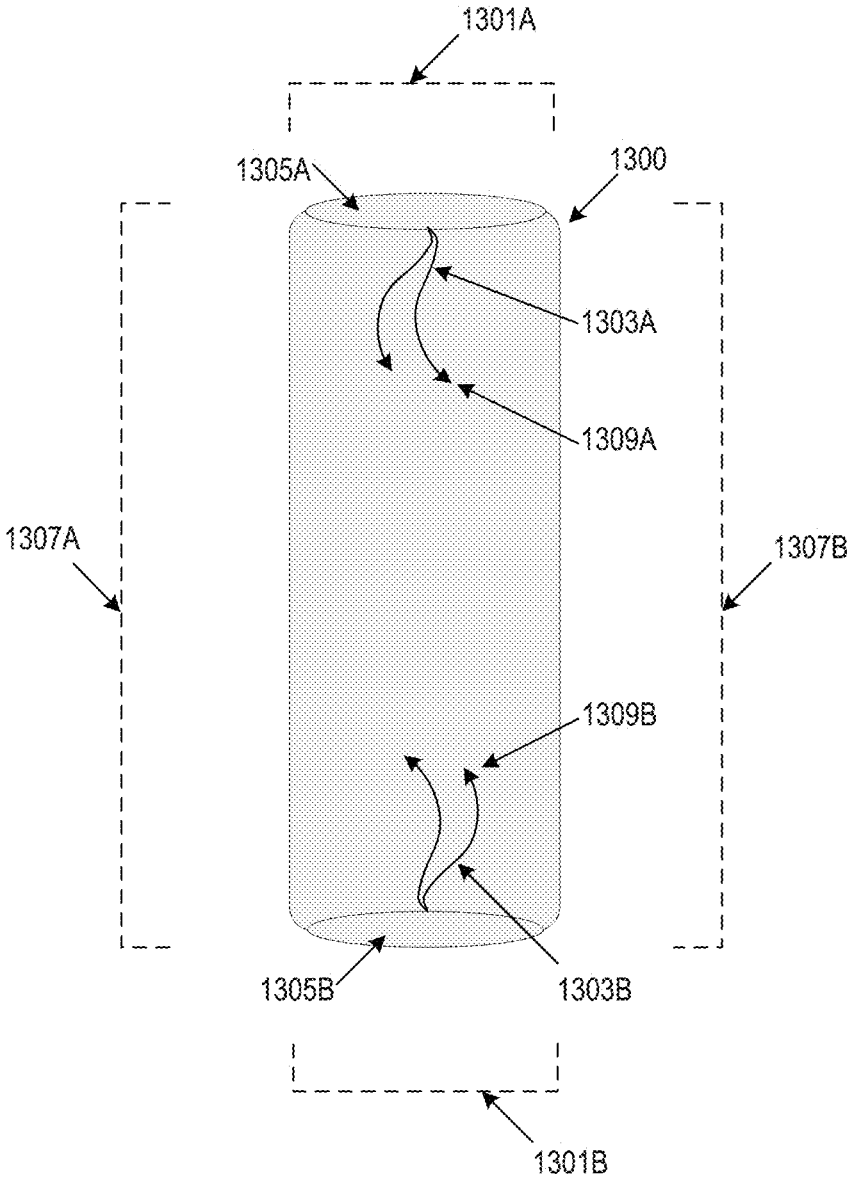
FIG. 13 illustrates a head piece having a pair of openings, in accordance with various examples of the present disclosure.

FIG. 13 illustrates a head piece 1300 having a pair of openings, in accordance with various examples of the present disclosure. The head piece 1300 can be compact and lightweight. The head piece 1300 can be constructed of one or more fabrics and materials. Example fabrics and materials can include spandex, Lycra, nylon or a combination thereof. The fabric of the head piece 1300 can be constructed to form a circular tube having short sides 1301A,1301B and long sides 1307A,1307B. The head piece 1300 can have one or more pairs of openings 1305A,1305B. A head piece having multiple pairs of openings is discussed in greater detail below in conjunction with FIG. 14, in accordance with various examples of the present disclosure. Referring to FIG. 13, the head piece 1300 can have one or more fasteners (e.g., drawstrings, cord locks, zippers, snaps, or other fasteners) to adjust and/or close the openings 1305A,1305B. For example, the head piece 1300 can have mechanisms (e.g., sets of drawstrings 1303A,1303B and/or cord locks 1309A,1309B) at the openings 1301A, 1301B to adjust the diameter of a respective opening 1305A,1305B and/or close a respective opening 1305A,1305B.

In one example, to wear the head piece 1300 as a hoodie, a person can slide the head piece 1300 via openings (e.g., openings 1305A,1305B) vertically over the person's head until the bottom opening (e.g., opening 1305B) of the head piece 1300 rests just below the base of the person's neck and at the top of the person's shoulders. The head piece 1300 can include fasteners to couple the head piece to one or more layers of the all-in-one water apparel. The top opening (e.g., opening 1305A) at the other end of the head piece 1300 can be left open. The drawstrings (e.g., drawstrings 1303B) can be pulled together to decrease the diameter of the respective opening (e.g., opening 1305B) to increase the covering of the person's head, neck, ear, and/or face to provide further body protection.

Figure 14:
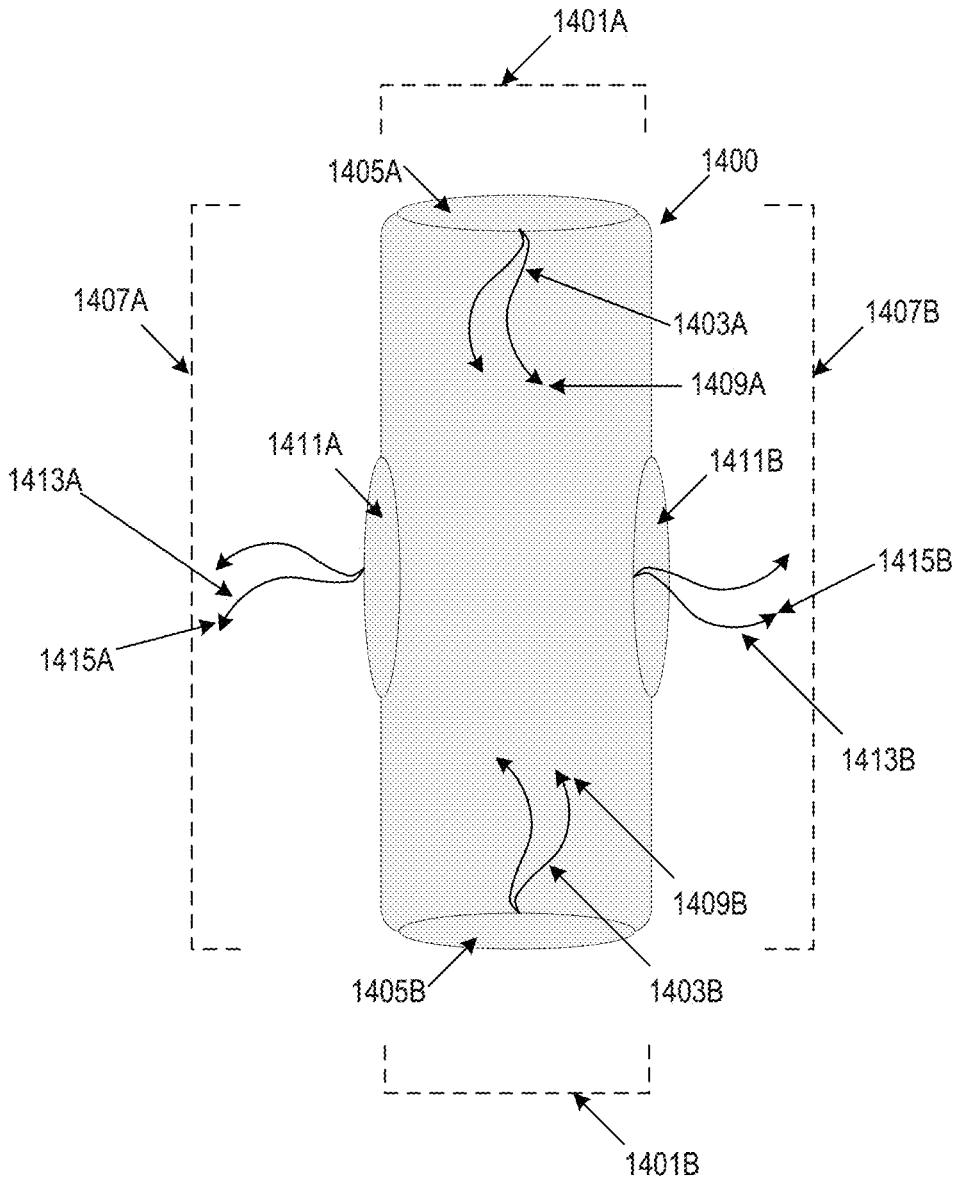
FIG. 14 illustrates a head piece having multiple pairs of openings, in accordance with various examples of the present disclosure.

FIG. 14 illustrates a head piece 1400 having multiple pairs of openings, in accordance with various examples of the present disclosure. Head piece 1400 can form a circular tube having short sides 1401A,1401B and long sides 1407A, 1407B. The head piece 1400 can have multiple pairs of openings (e.g., pair of openings 1405A,1405B and pair of openings 1411A,1411B). The head piece 1400 can have mechanisms (e.g., set of drawstrings 1403A, 1403B, set of drawstrings 1413A,1413B, cord locks 1409A,1409B, and/or cord locks 1415A, 1415B) at the openings 1405A,1405B, 1411A,1411B to adjust the diameter of a respective opening and/or close a respective opening.

A head piece (e.g., head piece 1400, head piece 1300 in FIG. 13) can be worn by a person with the long sides (e.g., long sides 1407A,1407B, long sides 1307A1307B in FIG. 13) vertically. "Vertically" hereinafter refers to the head piece having its long sides in a vertical (portrait) orientation. For example, a person can position head piece 1400 vertically and slide the head piece 1400 down over the person's head and/or the upper body using the openings 1405A, 1405B in the short sides 1401A,1401B of the head piece 1400. In another example, a person can position head piece 1400 vertically and step into the openings (e.g., opening 1405A,1405B) in the short sides 1401A,1401B of the head piece 1400 and slide the head piece 1400 up over the person's body.

A head piece (e.g., head piece 1400, head piece 1300 in FIG. 13) can be a multi-purpose fashionable accouterment that can be transformed into multiple garments (e.g., hoodie, top, dress, skirt, scarf, wrap, shawl) and/or container tote bag. A head piece transformed into a container tote bag is discussed in greater detail below in conjunction with FIG. 18 below, in accordance with various examples of the present disclosure.

Referring to FIG. 14, a head piece (e.g., head piece 1400, head piece 1300 in FIG. 13) having a pair of openings at the short sides (e.g., short sides 1401A,1401B, short sides 1301A,1301B in FIG. 13) can be worn by a person vertically to transform the head piece from one garment (e.g., hoodie, top, dress, skirt, scarf, wrap, shawl) to a different garment (e.g., hoodie, top, dress, skirt, scarf, wrap, shawl). The head piece (e.g., head piece 1400, head piece 1300 in FIG. 13) is a versatile piece of clothing that can be worn as a casual garment and transformed into to a formal and/or glamorous garment, and vice versa.

Figure 15:
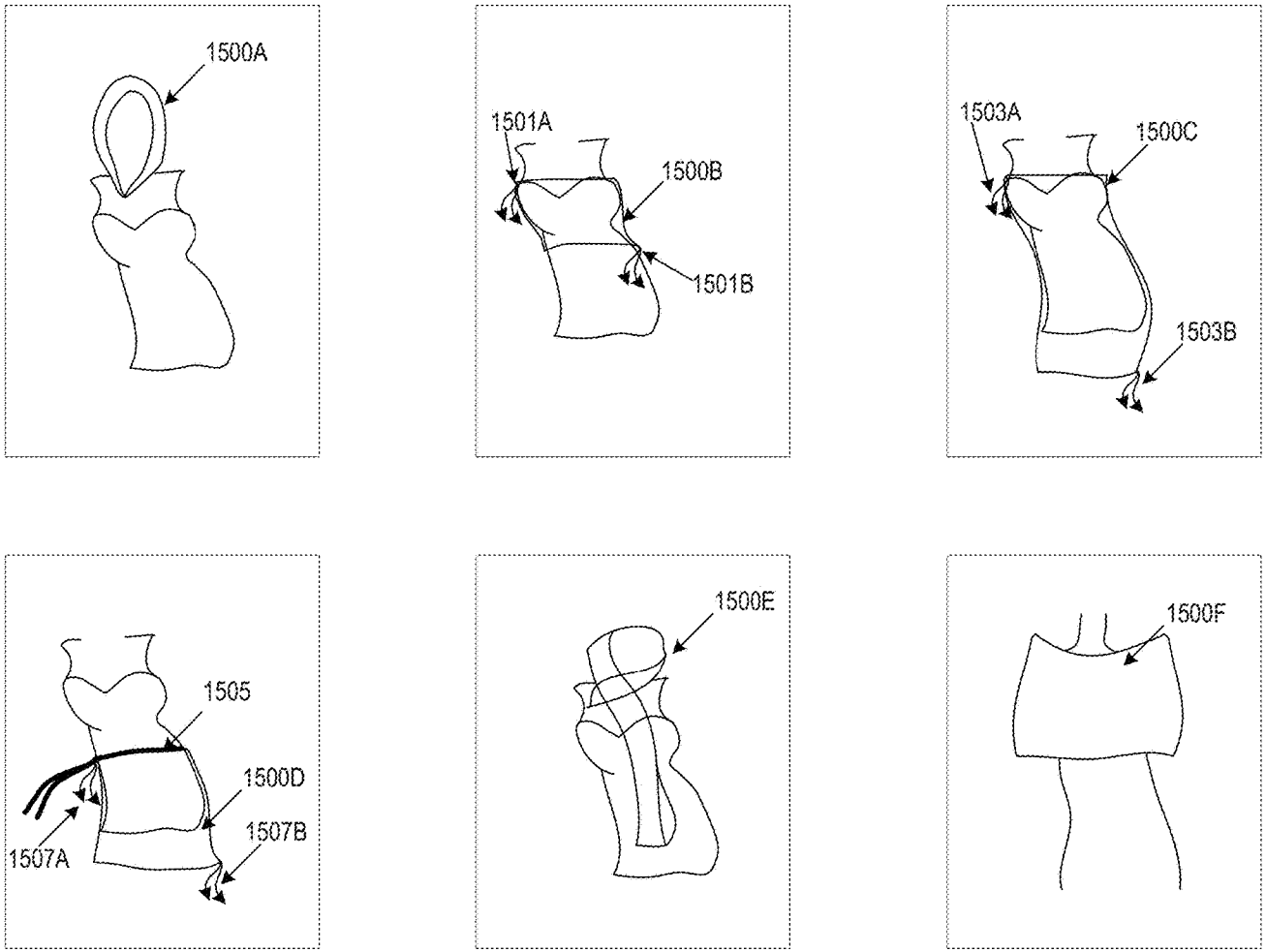
FIG. 15 illustrates a head piece being worn vertically to transform into various garments, in accordance with various examples of the present disclosure.

FIG. 15 illustrates a head piece being worn vertically to transform into various garments, in accordance with various examples of the present disclosure. Head piece 1500A has been transformed into a head covering (hoodie). As discussed above, in one example, to wear the head piece 1500A as a hoodie, a person can slide the head piece 1500A via openings over the person's head until the bottom opening of the head piece 1500A rests just below the base of the person's neck and at the top of the person's shoulders. The top opening at the other end of the head piece 1500A can be left open. The drawstrings can be pulled together to decrease the diameter of the respective opening.

Head piece 1500B has been transformed into a top (e.g., halter top, sleeveless top). In one example, to wear the head piece 1500B as a sleeveless top, a person can slide the head piece 1500B via openings (e.g., openings 1405A,1405B in FIG. 14) in the short sides (e.g., short sides 1401A,1401B in FIG. 14) over the person's head until the person's arms pass through the openings at both short sides of the head piece 1500B. When a person selects a desired vertical length for the sleeveless top, the drawstrings 1501A,1501B can be pulled together and cord locks can be enabled to tighten the diameter of the respective opening for locking the desired length of the sleeveless top. For example, one opening can be aligned around a person's bust/chest and tightened with a corresponding set of drawstrings (e.g., drawstrings 1501A). The drawstrings (e.g., drawstrings 1501B) corresponding to the other opening at the other short side of the head piece can be cinched at the person's waist or left open to fall freely down the person's body for the length of the head piece garment.

Head piece 1500C has been transformed into a strapless dress. In one example, to wear the head piece 1500C as a strapless dress, a person can slide the head piece 1500C via openings (e.g., openings 1405A,1405B in FIG. 14) in the short sides (e.g., short sides 1401A, 1401B in FIG. 14) over the person's head until the person's arms pass through the openings at both short sides of the head piece 1500C. When a person selects a desired vertical length for the sleeveless top, for example, below the person's buttocks, the drawstrings 1503A,1503B can be pulled together and cord locks can be enabled to tighten the diameter of the respective opening for locking the desired length of the strapless dress. For example, one opening can be aligned around a person's bust/chest and tightened with a corresponding set of drawstrings (e.g., drawstrings 1503A). The drawstrings (e.g., drawstrings 1503B) corresponding to the other opening at the other short side of the head piece can be cinched at the person's mid-thigh or left open to fall freely down the person's body for the length of the head piece garment.

Head piece 1500D has been transformed into a skirt. In one example, to wear the head piece 1500D as a skirt, a person can slide the head piece 1500D via openings (e.g., openings 1405A,1405B in FIG. 14) in the short sides (e.g., short sides 1401A, 1401B in FIG. 14) over the person's head, for example, until the person's arms pass through the openings at both short sides of the head piece 1500D and the head piece 1500D may slide down to the person's waist. The person can also step into the openings of the head piece 1500D and slide the head piece 1500D up until, for example, the top opening of the head piece 1500D is situated at the person's waist. When a person selects a desired vertical length for the sleeveless top, for example, below the person's buttocks, the drawstrings 1507A,1507B can be pulled together and cord locks can be enabled to tighten the diameter of the respective opening for locking the desired length of the skirt. For example, one opening can be aligned around a person's waist or hips and tightened with a corresponding set of drawstrings (e.g., drawstrings 1507A). The drawstrings (e.g., drawstrings 1507B) corresponding to the other opening at the other short side of the head piece can be cinched at or below the person's thighs or left open to fall freely down the person's body for the length of the head piece garment.

The head piece 1500D can include a sash/belt as an accessory to increase the person's fashion options. A piece of fabric 1505 can be coupled to a head piece 1500D and detached from the head piece 1500D to serve as a sash or belt when the head piece 1500D is worn as a skirt, dress, bottom and/or top. The fabric 1505 can be of the same material as the head piece 1500D.

Head piece 1500E has been transformed into a scarf. The head piece 1500E can be folded along its long sides (e.g., long sides 1307A,1307B in FIG. 13, long sides 1407A, 1407B in FIG. 14) and can be draped as a scarf around a person's neck.

Illustrated in a back view, head piece 1500F has been transformed into a wrap or shawl. Head piece 1500F can be worn in a horizontal orientation, stretched around a person's back, and draped as wrap or shawl around the person's shoulders. Drawstrings can be tied to secure the head piece 1500F as a wrap or shawl around the person's shoulders.

Figure 16:
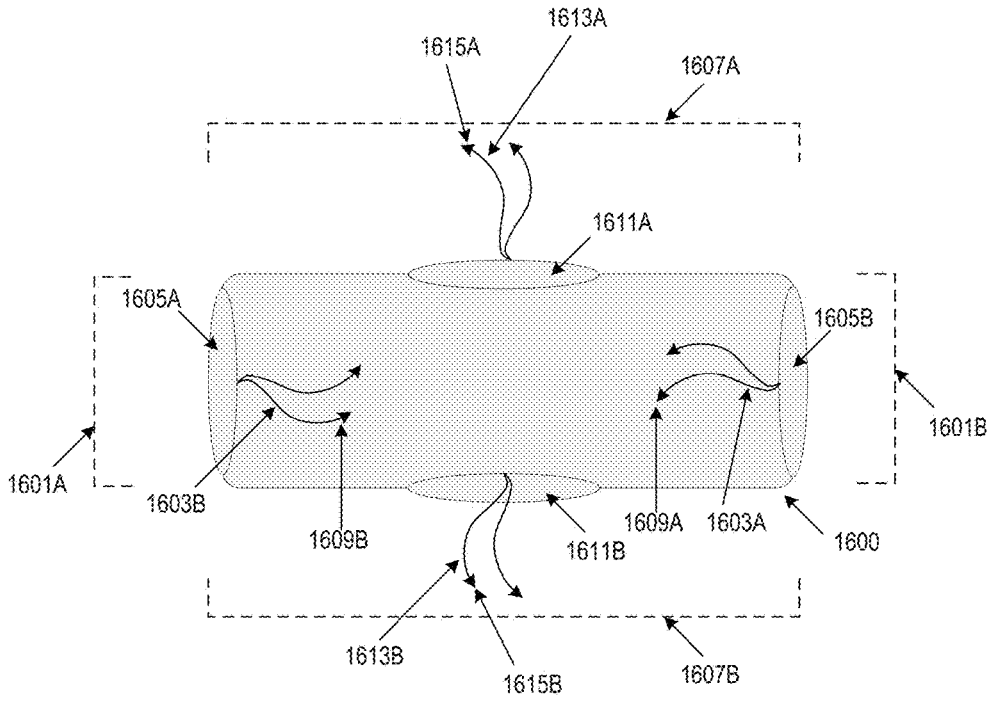
FIG. 16 illustrates a head piece in a horizontal orientation, in accordance with various examples of the present disclosure.

FIG. 16 illustrates a head piece 1600 in a horizontal orientation, in accordance with various examples of the present disclosure. Head piece 1600 can form a circular tube having short sides 1601A,1601B and long sides 1607A, 1607B. The head piece 1600 can have multiple pairs of openings (e.g., pair of openings 1605A,1605B and pair of openings 1611A,1611B). The head piece 1600 can have mechanisms (e.g., set of drawstrings 1603A,1603B, set of drawstrings 1613A,1613B, cord locks 1609A,1609B, and/or cord locks 1615A,1615B) at the openings 1605A,1605B, 1611A,1611B to adjust the diameter of a respective opening and/or close a respective opening.

A head piece (e.g., head piece 1600, head piece 1300 in FIG. 13, head piece 1400 in FIG. 14) can be worn by a person with the long sides (e.g., long sides 1607A,1607B, long sides 1307A,1307B in FIG. 13, long sides 1407A, 1407B in FIG. 14) horizontally. "Horizontally" hereinafter refers to the head piece having its long sides in a horizontal (landscape) orientation. For example, a person can position head piece 1600 horizontally and slide the head piece 1600 down over the person's head and/or the upper body using the openings 1611A,1611B in the long sides 1607A,1607B of the head piece 1600. In another example, a person can position head piece 1600 horizontally and step into step into the openings (e.g., opening 1611A,1611B) in the long sides 1607A,1607B of the head piece 1600 and slide the head piece 1600 up over the person's body.

A head piece (e.g., head piece 1600, head piece 1300 in FIG. 13, head piece 1400 in FIG. 14) that includes a pair of openings at the short sides (e.g., short sides 1601A,1601B, short sides 1301A,1301B in FIG. 13, short sides 1401A, 1401B in FIG. 14) and a pair of openings at the long sides (e.g., long sides 1607A,1607B, long sides 1307A,1307B in FIG. 13, long sides 1407A,1407B in FIG. 14) can be worn by a person horizontally to transform the head piece to a garment (e.g., top with sleeves, sleeveless top, hoodie, dress, skirt, scarf, wrap, and/or shawl).

Figure 17:
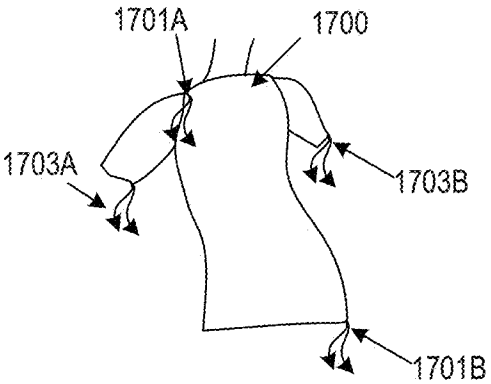
FIG. 17 illustrates a head piece transformed into a blouse with sleeves, in accordance with various examples of the present disclosure.

FIG. 17 illustrates a head piece 1700 transformed into a blouse with sleeves, in accordance with various examples of the present disclosure. In one example, to wear the head piece 1700 as a top with sleeves, a person can slide the head piece 1700 via openings (e.g., openings 1611A,1611B in FIG. 16) in the long sides (e.g., long sides 1607A,1607B in FIG. 16) of the head piece 1700 over the person's head. The person can push their arms through the openings (e.g., openings 1605A,1605B in FIG. 16) in the short sides (e.g., short sides 1601A,1601B in FIG. 16) of the head piece 1700. One opening (e.g., opening 1611B in FIG. 16) in a long side (e.g., long side 1607B in FIG. 16) can sit at the person's waist or can fall below the person's waist. For example, the opening (e.g., opening 1611B in FIG. 16) can be aligned with the person's thighs or until the head piece 1700 reaches its maximum length. In one example, when a person selects a desired length for each sleeve, the drawstrings 1703A, 1703B can be pulled together and cord locks can be enabled to tighten the diameter of the respective opening for locking the desired sleeve length for a respective sleeve of the top. For example, the left opening (e.g., opening 1605A in FIG. 16) can be aligned at a person's elbow and tightened with a corresponding set of drawstrings (e.g., drawstrings 1703A), and the right opening (e.g., opening 1605B in FIG. 16) can be aligned at a person's elbow and tightened with a corresponding set of drawstrings (e.g., drawstrings 1703B).

When a person selects a desired vertical length for the top, the bottom drawstrings 1701B can be pulled together and cord locks can be enabled to tighten the diameter of the respective opening for locking the desired length of the top.

For example, the top opening can be aligned at a person's neckline and tightened with a corresponding set of drawstrings (e.g., drawstrings 1701A). The drawstrings (e.g., drawstrings 1701B) corresponding to the bottom opening at the other short side of the head piece 1700 can be cinched at the person's waist. In one example, the head piece 1700 can transform into a blouse with sleeves without having drawstrings and/or cord locks.

Multiple head pieces can be used together to create multiple garments for the all-in-one water apparel. For example, one head piece can be a hoodie and another head piece can be a blouse, skirt, or wrap, or any combination or such.

Figure 18:
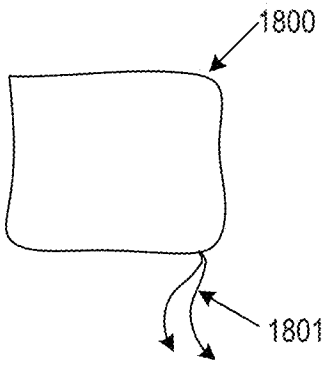
FIG. 18 illustrates a head piece transformed into a container to store one or more other components of the all-in-one water apparel, in accordance with various examples of the present disclosure.

FIG. 18 illustrates a head piece 1800 transformed into a container to store one or more other components of the all-in-one water apparel, in accordance with various examples of the present disclosure. The head piece 1800 can transform into a container to store one or more other components of the all-in-one water apparel. The head piece 1800 can include one or more closures to convert the head piece 1800 into a storage container (e.g., tote storage bag) to contain the components of the all-in-one water apparel. For example, one or more other components (e.g., overlay layer, underlay layer, sash, other head piece(s)) of the all-in-one water apparel can be inserted into an opening, and the openings can be closed via one or more closing mechanisms 1801 (e.g., drawstrings, cord locks). The head piece 1800 can be folded into a container tote bag for a person to carry.

In the foregoing description, numerous details are set forth. It will be apparent, however, to one of ordinary skill in the art having the benefit of this disclosure, that the present disclosure can be practiced without these specific details. In some instances, well-known structures and devices are shown in block diagram form, rather than in detail, in order to avoid obscuring the present disclosure.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or." Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion.

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A multi-component, multi-function water-resistant garment ensemble, comprising:

a water resistant underlay garment layer configured with at least one compression panel for wear on a wearer in a wearer selected body location;

a water resistant overlay garment layer configured for wear over said water resistant underlay garment layer while exposing at least a portion of said underlay garment layer through said overlay layer garment material; said water resistant overlay garment layer and said water resistant underlay garment layer each include a complementary set of fasteners configured to attach and detach said water resistant overlay garment layer to said water resistant underlay garment layer as desired when worn;

said ensemble further comprising a transformable tubular headpiece component formed as a tubular garment component constructed of a stretchable material having an open top end, an open bottom end and long side edges there between said top end and said bottom end; said transformable tubular garment head piece is configured for wear on said wearer and is transformable and reconfigurable as multiple alternative and different body garments wearable on different areas of said wearer's body; said transformable tubular garment head piece includes at least one opening on each of said long side edges configured for extension of a wearer's body part there through as desired when worn;

wherein a wearer of said ensemble selectively wears at least two of any of said water resistant overlay garment layer, said water resistant underlay garment layer and said transformable tubular head piece garment in any selected one of the transformable tubular headpiece garment's configurations while said underlay garment layers compression panel compresses said wearer at said panel body location.

2. A multi-component, multi-function water-resistant garment ensemble as claimed in claim 1 and further comprising:

said transformable tubular headpiece component top end, bottom end and/or said at least one opening on each of said long side edges include a closure to allow for selectively opening or closing said component top end, bottom end and/or said at least one opening on each of said long side edges.

3. A multi-component, multi-function water-resistant garment ensemble as claimed in claim 2 and further comprising:

said transformable tubular headpiece component further includes more than one opening on each of said long side edges and is configured for placement of a wearer's body parts there through when worn and wherein said transformable tubular headpiece component is configured for wear on said wearer as any of an upper torso body garment including a dress, a top or blouse, a wrap, a shrug, a scarf, a shawl, a hoodie, a hood, a lower torso body garment of a skirt, shorts or pants of any leg length, an extremity covering body garment as desired, or when said openings are all closed with said closures, as a bag.

4. A multi-component, multi-function water-resistant garment ensemble as claimed in claim 1 and further comprising:

said transformable tubular headpiece component top end and bottom end each include a cord within a circumferential tunnel at each of said top and bottom ends and wherein said cord is configured to be gathered within said tunnel at each said end as desired to tighten said tubular garment ends on or about said wearer's body portion when worn and/or when not worn on said wearer said cord is configured to gather said open top or bottom end to close said ends and form a bag.

5. A multi-component, multi-function water-resistant garment ensemble as claimed in claim 1 and further comprising:

said transformable tubular headpiece component top end, bottom end and/or said at least one opening on each of said long side edges include a closure configured for selectively opening or closing said component top end, bottom end and/or said at least one opening on each of said long side edges;

and wherein said transformable tubular headpiece component is configured for placement of a wearer's body parts there through wherein said transformable tubular headpiece component is wearable as any of an upper torso body garment including any configuration as a dress, a top or blouse, a wrap, a shrug, a scarf, a shawl, a hoodie, a hood, a lower torso body garment of a skirt, shorts or pants of any leg length, an extremity covering body garment as desired, or when said openings are all closed with said closures, as a bag.

6. A multi-component, multi-function water-resistant garment ensemble as claimed in claim 2 and further comprising:

said transformable tubular headpiece component top end and bottom end each include a cord within a circumferential tunnel at each of said top and bottom ends and wherein said cord is configured to be gathered within said tunnel at each said end as desired to tighten said tubular garment ends on or about said wearer's body portion when worn, and/or when not worn on said wearer, said cord is configured to gather said open top or bottom end to close said ends and form a bag.

7. A multi-component, multi-function water-resistant garment ensemble as claimed in claim 4 and further comprising:

wherein said cord includes a cord lock on each said cord to secure said cord length after it is gathered within said circumferential tunnel to thereby tighten said cord about said wearer as desired.

8. A multi-component, multi-function water-resistant garment ensemble as claimed in claim 6 and further comprising:

wherein said cord includes a cord lock on each said cord to secure said cord length after it is gathered within said circumferential tunnel to thereby tighten said cord about said wearer as desired.

9. A multi-component, multi-function water-resistant garment ensemble as claimed in claim 1 and further comprising:

wherein each of said long side edges each include at least one opening therein that are configured for extending any of a wearer's arms, legs, head , hand or feet there through as desired when worn.

10. A multi-component, multi-function water-resistant garment ensemble as claimed in claim 2 and further comprising:

said transformable tubular headpiece component further includes more than one opening on each of said long side edges that are configured for extending any of a wearer's arms, legs, head , hand or feet there through as desired when worn.

11. A multi-component, multi-function water-resistant garment ensemble as claimed in claim 1 and further comprising:

wherein said overlay garment layer includes at least one compression panel therein.

12. A multi-component, multi-function water-resistant garment ensemble as claimed in claim 2 and further comprising:

wherein said overlay garment layer includes at least one compression panel therein.

13. A multi-component, multi-function water-resistant garment ensemble as claimed in claim 1 and further comprising:

wherein any of said underlay garment layer, overlay garment layer and/or said transformable tubular head piece are configured for protecting said wearer from ultraviolet light.

14. A multi-component, multi-function water-resistant garment ensemble as claimed in claim 2 and further comprising:

wherein any of said underlay garment layer, overlay garment layer and/or said transformable tubular head piece are configured for protecting said wearer from ultraviolet light.

15. A multi-component, multi-function water-resistant garment ensemble as claimed in claim 1 and further comprising:

wherein said ensemble further includes a sash for wear on or over any of said underlay garment layer, said overlay garment layer or said transformable tubular head piece component as desired.

16. A multi-component, multi-function water-resistant garment ensemble as claimed in claim 2 and further comprising:

wherein said ensemble further includes a sash for wear on or over any of said underlay garment layer, said overlay garment layer or said transformable tubular head piece component as desired.

17. A multi-component, multi-function water-resistant garment ensemble as claimed in claim 1 and further comprising:

wherein said ensemble includes multiple garment components including multiples of any of said underlay garment layers, said overlay garment layers or said transformable tubular head piece garment components to allow for selective wear of said component garments as desired by said wearer when worn.

18. A multi-component, multi-function water-resistant garment ensemble as claimed in claim 2 and further comprising:

wherein said ensemble includes multiple garment components including multiples of any of said underlay garment layers, said overlay garment layers or said transformable tubular head piece garment components to allow for selective wear of said component garments as desired by said wearer when worn.

19. A multi-component, multi-function water-resistant garment ensemble as claimed in claim 1 and further comprising:

wherein any of said underlay garment layer, said overlay garment layer or said transformable tubular head piece component are formed of a reversible fabric material whereby said garment component formed of said reversible fabric material is reversible when worn to allow for many different alternative garment configurations.

20. A multi-component, multi-function water-resistant garment ensemble as claimed in claim 2 and further comprising:

wherein any of said underlay garment layer, said overlay garment layer or said transformable tubular head piece component are formed of a reversible fabric material whereby said garment component formed of said reversible fabric material is reversible when worn to allow for many different alternative garment configurations.

21. A multi-component, multi-function water-resistant garment ensemble as claimed in claim 1 and further comprising:

wherein any of said underlay garment layer, said overlay garment layer or said transformable tubular head piece component include at least one pocket therein.

22. A multi-component, multi-function water-resistant garment ensemble as claimed in claim 2 and further comprising:

wherein any of said underlay garment layer, said overlay garment layer or said transformable tubular head piece component include at least one pocket therein.

23. A multi-component, multi-function water-resistant garment ensemble as claimed in claim 1 and further comprising:

wherein any of said underlay garment layer, said overlay garment layer or said transformable tubular head piece component include one or more pockets therein.

24. A multi-component, multi-function water-resistant garment ensemble as claimed in claim 2 and further comprising:

wherein any of said underlay garment layer, said overlay garment layer or said transformable tubular head piece component include one or more pockets therein.

25. A multi-component, multi-function water-resistant garment ensemble as claimed in claim 1 and further comprising:

wherein the water resistant overlay layer garment comprises a transparent fabric.

26. A multi-component, multi-function water-resistant garment ensemble as claimed in claim 2 and further comprising:

wherein the water resistant overlay layer garment comprises a transparent fabric.

27. A multi-component, multi-function water-resistant garment ensemble as claimed in claim 1 and further comprising:

wherein any of the water resistant underlay garment layer or overlay garment layer comprises an upper torso garment component that comprises one or more straps at a bottom end of said garment that are configured to encircle an upper portion of one or more legs of the wearer to secure said bottom end of said garment on said wearer to avoid exposure of said wearer.

28. A multi-component, multi-function water-resistant garment ensemble as claimed in claim 2 and further comprising:

wherein any of the water resistant underlay garment layer or overlay garment layer comprises an upper torso garment component that comprises one or more straps at a bottom end of said garment that are configured to encircle an upper portion of one or more legs of the wearer to secure said bottom end of said garment on said wearer to avoid exposure of said wearer.

29. A multi-component, multi-function water-resistant garment ensemble as claimed in claim 1 and further comprising:

wherein any of the water resistant underlay garment layer or overlay garment layer comprises a lower torso garment component that comprises one or more straps at a bottom end of said garment that are configured to encircle any part of a wearer's foot to secure said bottom end of said garment on said wearer.

30. A multi-component, multi-function water-resistant garment ensemble as claimed in claim 2 and further comprising:

wherein any of the water resistant underlay garment layer or overlay garment layer comprises a lower torso garment component that comprises one or more straps at a bottom end of said garment that are configured to encircle any part of a wearer's foot to secure said bottom end of said garment on said wearer.

31. A multi-component, multi-function water-resistant garment ensemble as claimed in claim 11 and further comprising:

wherein said overlay garment layer and/ or said underlay garment layer each include one or more compression panels configured to be located to cover any of a wearer's body location including any of a wearer's arms, chest area, shoulders, back, neck, body/torso, buttocks, ankle, hands, feet and/or legs and/ or any combinations of said wearer's body locations thereof.

32. A multi-component, multi-function water-resistant garment ensemble as claimed in claim 12 and further comprising:

wherein said overlay garment layer and/ or said underlay garment layer each include at one or more compression panels configured to be located to cover any of a wearer's body location including any of a wearer's arms, chest area, shoulders, back, neck, body/torso, buttocks, ankle, hands, feet and/or legs and/ or any combinations of said wearer's body locations thereof.

33. A multi-component, multi-function water-resistant garment ensemble as claimed in claim 1 and further comprising:

wherein said overlay garment layer, said underlay garment layer and/ or transformable tubular headpiece component each include at least one compression panel therein that is configured to be located to cover a wearer's body locations including any of a wearer's arms, chest area, shoulders, back, neck, body/torso, buttocks, ankle, hands, feet and/or legs and/ or any combinations of said wearer's body locations thereof.

34. A multi-component, multi-function water-resistant garment ensemble as claimed in claim 2 and further comprising:

wherein said overlay garment layer, said underlay garment layer and/ or transformable tubular headpiece component each include at least one compression panel therein that is configured to be located to cover any of a wearer's body locations including any of a wearer's arms, chest area, shoulders, back, neck, body/torso, buttocks, ankle, hands, feet and/or legs and/ or any combinations of said wearer's body locations thereof.

* * * * *